US010239589B2

(12) United States Patent
Murphy

(10) Patent No.: US 10,239,589 B2
(45) Date of Patent: Mar. 26, 2019

(54) UNDER SEAT CADDY FOR MARINE CRAFT

(71) Applicant: Premier Marine, Inc., Wyoming, MN (US)

(72) Inventor: Mikenzie Murphy, Forest Lake, MN (US)

(73) Assignee: Premier Marine, Inc., Wyoming, MN (US)

( * ) Notice: Subject to any disclaimer, the term of this patent is extended or adjusted under 35 U.S.C. 154(b) by 51 days.

(21) Appl. No.: 15/248,121

(22) Filed: Aug. 26, 2016

(65) Prior Publication Data

US 2018/0057116 A1 Mar. 1, 2018

(51) Int. Cl.
*B63B 29/00* (2006.01)
*B63B 29/04* (2006.01)

(52) U.S. Cl.
CPC ..... *B63B 29/04* (2013.01); *B63B 2029/043* (2013.01)

(58) Field of Classification Search
CPC . B63B 25/004; B63B 29/04; B63B 2029/043; B63C 9/00
USPC ..... 224/406
See application file for complete search history.

(56) References Cited

U.S. PATENT DOCUMENTS 4,682,813 A 7/1987 Fohr et al.
4,745,704 A 5/1988 Schaefer
4,790,432 A * 12/1988 Rees ..... A01K 97/06 206/315.11
5,188,442 A * 2/1993 Harty ..... A01K 97/06 297/188.11
5,586,806 A * 12/1996 Hergott ..... A47C 7/62 297/188.11
5,820,210 A 10/1998 Shipman et al.
D442,809 S 5/2001 de Windt, Jr. et al.
7,658,442 B1 * 2/2010 Whiteside ..... A47C 7/62 297/188.01
8,544,944 B1 10/2013 Gelley
2006/0006705 A1 1/2006 Charbonneau
2007/0080565 A1 4/2007 Mankovitz
2009/0079244 A1 3/2009 Kelleher
2015/0320223 A1 11/2015 Nugent

FOREIGN PATENT DOCUMENTS

CN 202941657 5/2013
CN 204048800 12/2014
JP H09168453 6/1997
KR 100964803 2/2008
KR 2011000161 1/2011
WO 96019133 6/1996
WO 99017639 4/1999

* cited by examiner

*Primary Examiner* — Peter Helvey
(74) *Attorney, Agent, or Firm* — Shumaker & Sieffert, P.A.

(57) ABSTRACT

A storage caddy system for mounting underneath a seat has a mounting bracket for attachment between a bottom of the seat and at least one leg, and a storage caddy removably attached to the mounting bracket. The storage caddy has at least one storage compartment for storing an item, which is accessible by at least one access point in an outer wall of the storage caddy. The storage caddy is configured to allow movement of the seat relative to the leg. The storage caddy is slidable relative to the mounting bracket in a direction perpendicular to the leg from a partially stowed position to a fully stowed position.

17 Claims, 8 Drawing Sheets

UNDER SEAT CADDY FOR MARINE CRAFT

FIELD OF THE INVENTION

The present disclosure relates to storage devices for use in vehicles and marine craft. Particularly, the present disclosure relates to under seat storage devices.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Storage space in vehicles, and especially in marine craft, is often limited and in demand. Many items are desired to be stored for later use or for emergency purposes. These items may include but are not limited to, food, water, other beverages, life jackets, floatation devices, maintenance items, fire extinguishers, flashlights, and first aid kits. For example, U.S. Coast Guard guidelines presently require that boats larger than 16 feet have at least one fire extinguisher; one sound producing device such as, but not limited, to a bell, whistle, or horn; and a signaling device such as, but not limited to, a flashlight, strobe, or flare. With respect to at least some of these stored items, it may be desirable for a user to be near the stored items for easy access, particularly in emergency situations. Often storage space is provided in, for example, pockets in the walls of the hull or vehicle or in substantially rigid storage compartments, such as glove compartments. These types of storage spaces are not often easily within the reach of a driver or operator of a vehicle, and they are often not removable storage compartments. There is a desire in the art to maximize the amount of storage space within the cabin area of a marine craft or other vehicle. There is further a need for storage compartments that are within reach of a driver, operator, or other user of a marine craft or other vehicle for times when quick and easy access to items is desirable.

BRIEF SUMMARY OF THE INVENTION

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

Embodiments of the present disclosure involve a storage caddy system removably attached to a seat, where the seat is attached to at least one leg or to the wall of the vehicle. The storage caddy may comprise a mounting bracket for attachment between a bottom of the seat and the at least one leg, and a storage caddy removably attached to the mounting bracket. The mounting bracket may have at least two sides. The mounting bracket may further comprise a mounting portion for mounting the mounting bracket between the bottom of the seat and the at least one leg; and at least one retaining portion on each side of the mounting bracket. Each retaining portion may have an attachment feature on a first side of the mounting bracket. The at least one retaining portion may have a position relatively lower than the mounting portion. The storage caddy comprises at least a bottom wall, an inner wall, and an outer wall. At least the bottom wall, the inner wall, and the outer wall may define at least one storage compartment for storing an item. The at least one storage compartment may be accessible by at least one access point in the outer wall. The inner wall may define at least one slot for receiving the at least one leg. At least one attachment feature may be connected to at least one wall of the storage caddy, and each attachment feature may be capable of connecting to a mating attachment feature of the mounting bracket. In some embodiments, the storage caddy may be moved relative to the mounting bracket from a partially stowed position to a fully stowed position in a direction perpendicular to the at least one leg. In some embodiments, the outer wall comprises a flexible material. In some embodiments, the attachment feature of the storage caddy comprises at least one clip. The at least one clip may be a "J-clip" that defines a channel. The mounting bracket may comprise an attachment feature for insertion into the channel of the "J-clip." The storage caddy system may further comprise dividers positioned in compartments to separate compartments into sections. Each section may have at least one access point with at least one closure mechanism.

The storage caddy system may further comprise a safety kit stored within at least one compartment. The safety kit may comprise a fire extinguisher stored in a first compartment of the storage caddy. The safety kit may further comprise a sound making device stored in a second compartment of the storage caddy. The second compartment may be smaller than the first compartment. The safety kit may further comprise a signaling device stored in a third compartment of the storage caddy.

In at least one embodiment, the storage caddy system comprises a mounting bracket for attachment between a bottom of the seat and the at least one leg and a storage caddy removably attached to the mounting bracket. The storage caddy may comprise a bottom wall; an inner wall having a slot for receiving at least one leg, the inner wall having a U-shaped configuration; an outer wall, the outer wall having a first side, a second side, and at least one end. The storage caddy may have at least one storage compartment for storing an item, the at least one storage compartment defined by at least the bottom wall, the inner wall, and the outer wall. The storage caddy may have at least one access point in the first side of the outer wall providing access to the at least one storage compartment when the storage caddy is in any of a fully removed position, a partially stowed position or a fully stowed position. In some embodiments, at least one attachment feature is connected to at least one wall of the storage caddy, each attachment feature capable of connecting to a mating attachment feature of the mounting bracket. The mounting bracket may further comprise a mounting portion for mounting the mounting bracket between the bottom of the seat and the at least one leg; and at least one retaining portion on each side of the mounting bracket, each retaining portion having an attachment feature on a first side of the mounting bracket, wherein the at least one retaining portion has a position relatively lower than the mounting portion.

In at least one embodiment, a removable storage caddy comprises an inner wall defining a slot for receiving at least one leg of a seat of the vehicle, wherein the inner wall has a U-shaped configuration; an outer wall; a bottom wall; at least one storage compartment for storing an item; and at least one attachment feature capable of being removably engaged with a mating attachment feature. The at least one storage compartment may be defined by at least the inner wall, the outer wall, and the bottom wall. The at least one storage compartment may be accessible by at least one access point in the outer wall, which may have a closure mechanism for accessing the item within the storage compartment. The at least one attachment feature may comprise a tab joined to at least a portion of the outer wall and extending upward from the outer wall; and a clip joined to the tab, the clip defining a channel for receiving the mating attachment feature.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present disclosure relates to novel and advantageous storage compartments for use on marine craft and in other vehicles. More particularly, the present disclosure relates to novel and advantageous removable storage caddies mounted underneath a seat with at least one compartment for storing items for easy access by a driver or passenger of the marine craft or vehicle.

Figure 1:
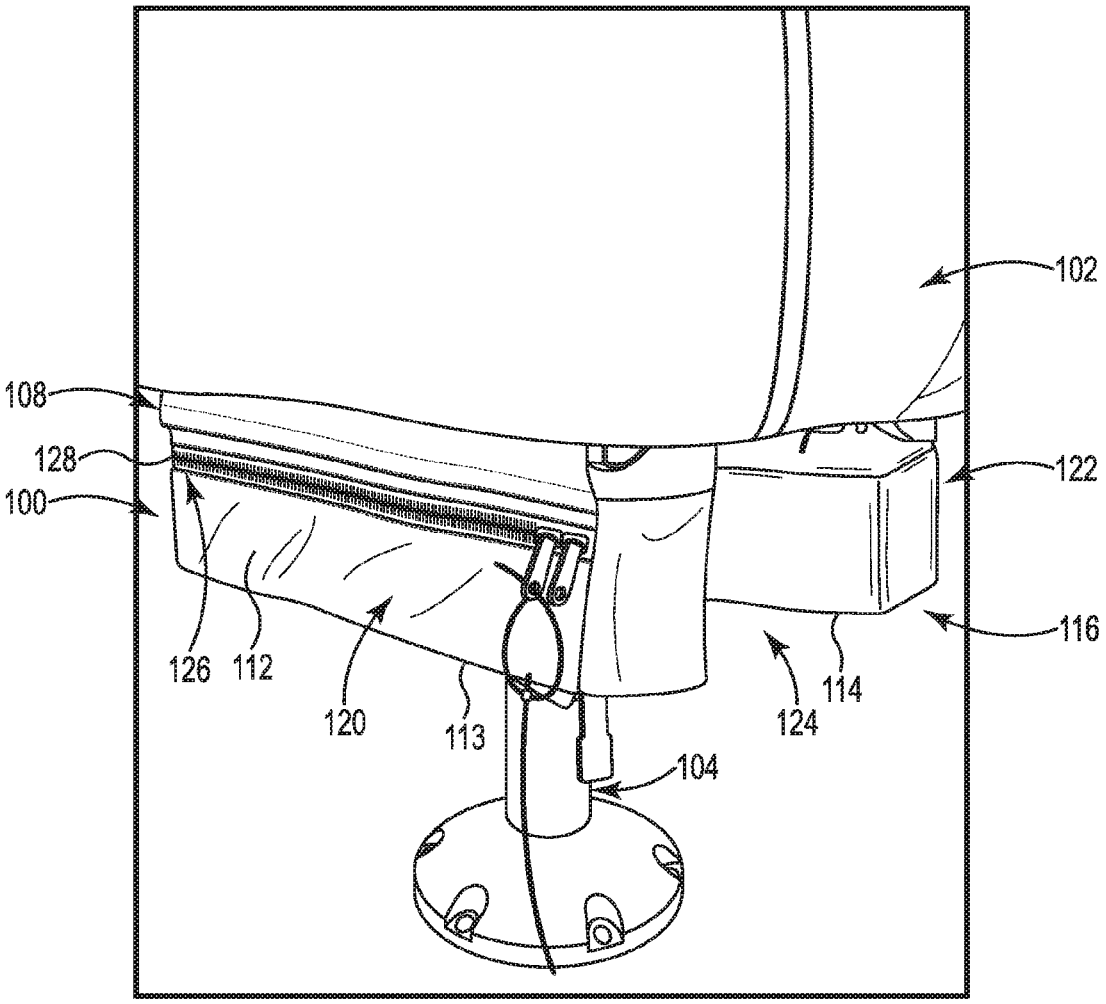
FIG. 1 shows a perspective view of one embodiment of the storage caddy system mounted to a seat in accordance with the present disclosure.
Figure 2:
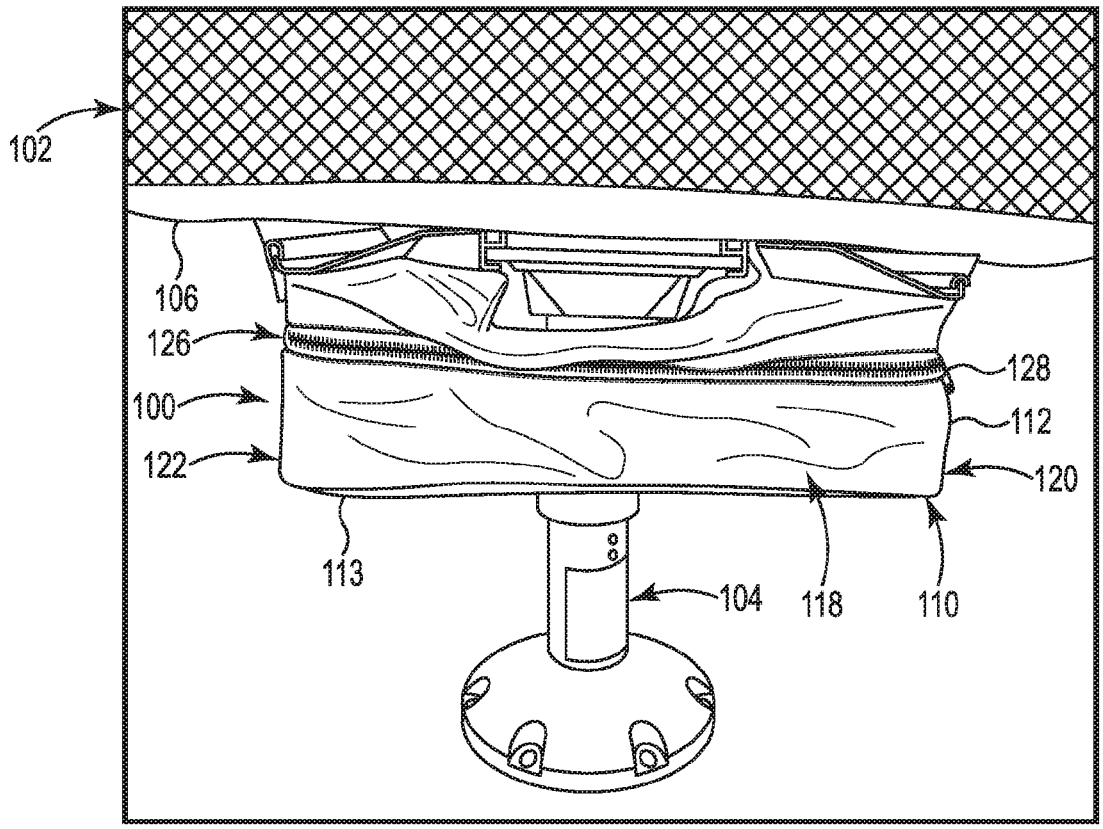
FIG. 2 shows a front view of the mounted storage caddy system of FIG. 1.
Figure 3:
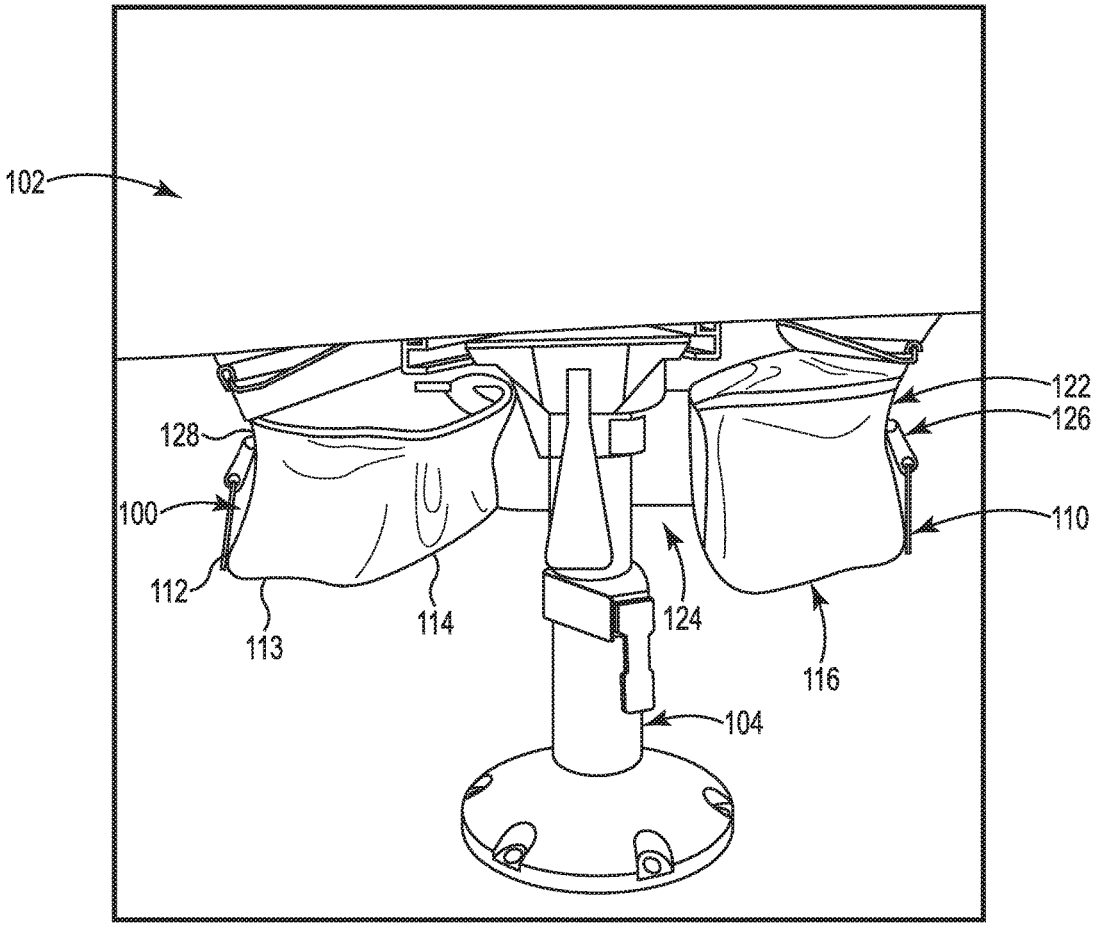
FIG. 3 shows a back view of the mounted storage caddy system of FIGS. 1-2.

FIGS. 1-3 show a storage caddy system 100 removably mounted under a seat 102 that is attached to at least one leg 104. The seat 102 may be a driver's seat, a captain's chair, a passenger's seat, a bench, or any other seat. In some embodiments, the seat 102 may swivel or otherwise rotate about the at least one leg 104. In other embodiments, the seat 102 may be in a fixed position relative to the at least one leg 104. In at least one embodiment, the seat 102 may adjustably slide in a first direction and a second direction about at least one leg 104. The storage caddy system 100 may be mounted underneath the seat 102. In at least one embodiment, the storage caddy system 100 comprises a storage caddy 110 removably mounted underneath the seat 102 via a mounting bracket 108 mounted between the at least one leg 104 and the seat 102.

The storage caddy 110 may have at least an outer wall 112, a bottom wall 113, and an inner wall 114 defining at least one compartment for storing at least one item. Any of the walls 112, 113, 114 may comprise a soft or flexible material such as plastic, cotton, canvas, nylon, leather, and other textiles, or combinations thereof. The walls 112, 113, 114 may be reinforced for increased rigidity of the storage caddy 110 to prevent or minimize sagging. The walls 112, 113, 114 may each comprise one or more layers of material. In at least one embodiment, at least one of the walls 112, 113, 114 may comprise at least one layer of a waterproof material. At least one of the walls 112, 113, 114 may comprise a thermal layer to keep cool or keep warm food, beverages, or other temperature-sensitive items that may be stored in the at least one compartment. Any of the walls 112, 113, 114 may comprise a relatively more rigid material or structure than any of the other walls. For example, in some embodiments, the inner wall 114 may comprise a more rigid material or structure than the outer wall 112 or the bottom wall 113. In some embodiments, the bottom wall 113 may comprise a more rigid material or structure than the inner wall 114 or the outer wall 112.

The outer wall 112 may comprise a perimeter that corresponds to at least a portion of a perimeter of the bottom 106 of the seat 102. In some embodiments, the outer wall 112 may define a generally rectangular, square, round, or curved wall configuration, but other shapes and configurations of the outer wall 112 are contemplated by this disclosure. In some embodiments, the outer wall 112 may define a first end 116, a second end 118, a first side 120, and a second side 122. In some of these embodiments, the storage caddy 110 may generally have a U-shaped configuration. At least one slot 124 may extend from the first end 116 towards the second end 118 between sides 120, 122. The at least one slot 124 may be configured to receive the at least one leg 104, such that the storage caddy 110 can fit generally around the leg 104. The at least one slot 124 may further be configured to allow movement, such as but not limited to rotational movement, of the seat 102 relative to the leg 104 while the storage caddy system 100 is mounted under the seat 102.

In at least one embodiment, the outer wall 112 has at least one access point 126 for accessing the contents of the storage caddy 110. In some embodiments, the access point 126 may comprise a closure mechanism 128, such as, but not limited to, a zipper, a hook and loop fastener system, snaps, buttons, or other securement means that allow for opening and closing the access point 126 to allow a user to access the compartment or securely close the compartment. In at least the embodiment shown in FIGS. 1-3, the at least one access point 126 may extend along at least a portion of the outer wall 112 along first side 120, along the second end 118, and then along the second side 122. Multiple access points 126 are also contemplated by this disclosure, examples of which are shown in other figures and discussed further below. Each access point 126 may be associated with one or more compartments of the storage caddy 110, and a user can access the contents of the compartments by opening the access point 126 using the closure mechanism 128 or secure the contents of the compartments by closing the access point using the closure mechanism 128.

Figure 4:
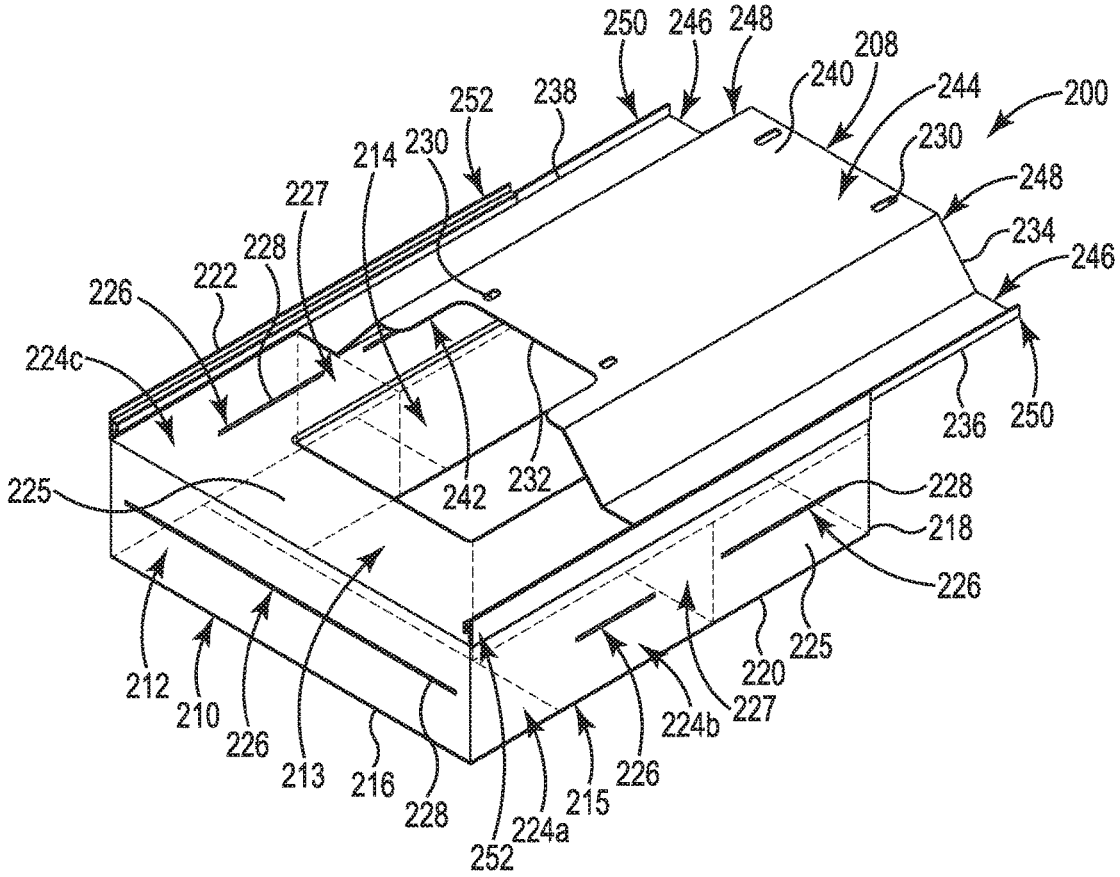
FIG. 4 shows a perspective schematic view of one embodiment of the storage caddy system in accordance with the present disclosure.
Figure 5:
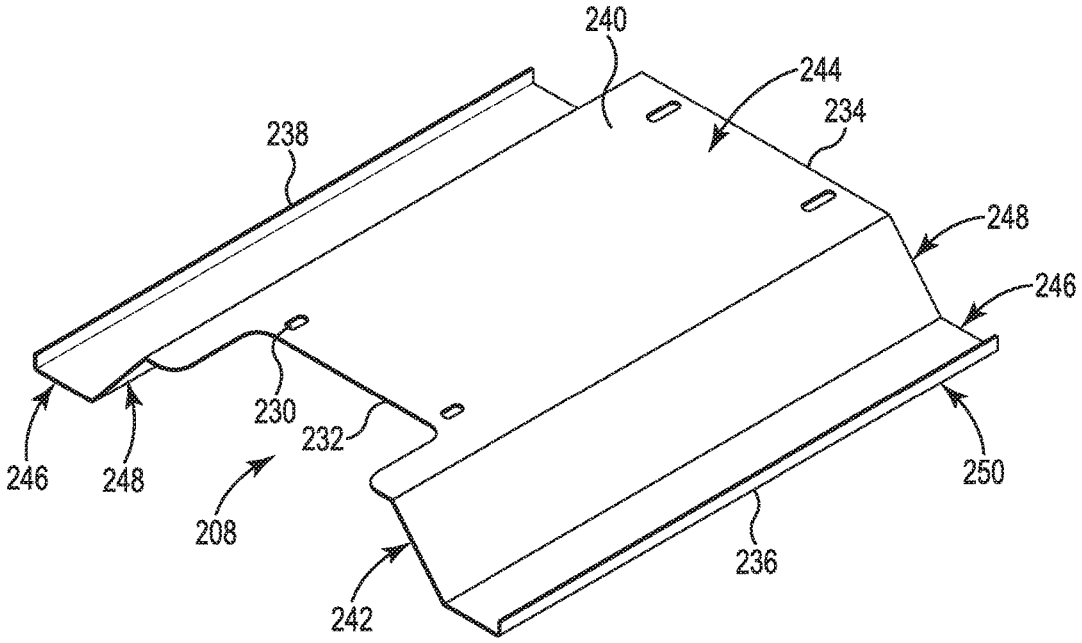
FIG. 5 shows a perspective schematic view of one embodiment of the mounting bracket of the storage caddy system of FIG. 4.
Figure 6:
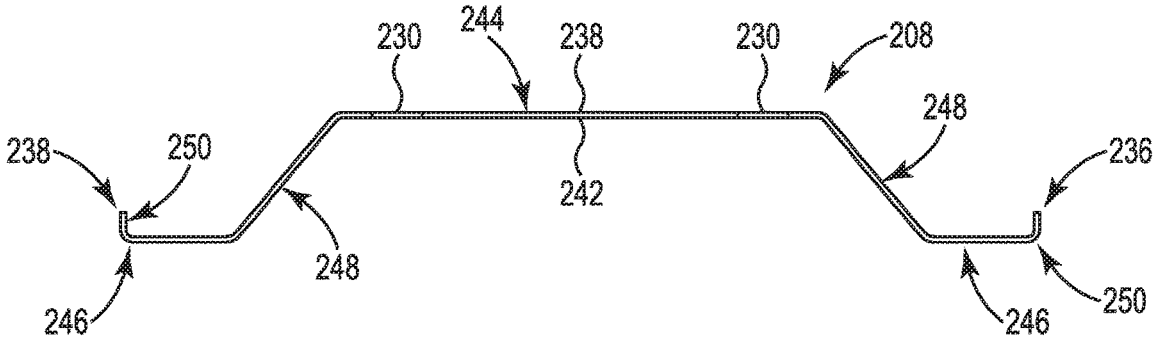
FIG. 6 shows an end schematic view of the mounting bracket of FIG. 5.

FIGS. 4-6 show another embodiment of the storage caddy system 200, prior to being mounted underneath a seat, the storage caddy system 200 having a mounting bracket 208 and storage caddy 210 configured to allow the storage caddy 210 to slide relative to the mounting bracket 208. The storage caddy 210 can be completely removed from the mounting bracket 208, or the storage caddy 210 can be positioned by the user between a partially stowed and fully stowed position with respect to the mounting bracket 208. To the extent that features of the storage caddy and mounting bracket have been discussed previously above, features of the embodiments in FIGS. 4-6 that are similar to those described above may have the same or similar structure and be made of the same or similar material as those similar features previously described.

The storage caddy 210 may have an outer wall 212, an inner wall 214, a first end 216, a second end 218, a first side 220, and a second side 222. In some embodiments, the storage caddy 210 may have a top wall 213 and a bottom wall 215. In other embodiments, the storage caddy may not have a top wall 213. At least the outer wall 212, the inner wall 214, and the bottom wall 215 may define at least one compartment 224 for storing at least one item. Each compartment may be used to store any one of several items, which may include but are not limited to food, beverages, maintenance items, safety items, or any other items with a size and shape able to fit within any compartment of the storage caddy. Each compartment may have an access point 226 with a closure mechanism 228.

As shown in FIG. 4, in one embodiment, a storage caddy 210 may have at least three compartments 224, and each compartment may have an access point 226 for accessing that compartment. Each access point 226 may have a closure mechanism 228 to allow access to the compartment. The storage caddy 210 shown in FIG. 4, for example, has an end compartment 224*a* at one end of the storage caddy 210, a first side compartment 224*b* on the first side 220, and a second side compartment 224*c* on the second side 222. Each of the side compartments 224*b*, 224*c* may be further split into smaller compartments. For example, side compartments 224*b* and 224*c* may be each further divided into multiple sections 225 using dividers 227. Although not necessary in all embodiments, each section 225 may have its own access point 226 with its own closure mechanism 228. The dividers 225 may be made of similar materials as the walls of the storage caddy 210 as discussed in more detail above, including but not limited to cotton, nylon, other textiles, plastics, and combinations thereof, or the dividers 225 may be made of materials that are more rigid than one or more of the walls. Where the storage caddy 210 is used for safety equipment, the front compartment 224*a*, or any other compartment, may be sized to store a fire extinguisher and the other compartments 224*b*, 224*c* allow for space for other safety equipment or emergency goods such as a first aid kit or flashlight. Of course, other suitable configurations for the compartments are contemplated by this disclosure and each compartment or section may be sized for a particular good or goods to be stored in that compartment or section. Each compartment may be divided into any number of sections as appropriate for the goods to be stored within that compartment.

The mounting bracket 208 may be configured to mount between a leg of a chair or bench, e.g. 104, and a seat of a chair or bench, e.g. seat 102. The mounting bracket 208 may be fixedly or removably mounted between the leg of the chair or bench and the seat of the chair or bench. The mounting bracket 208 may comprise a metal, polymer, wood, or other suitable material, and combinations thereof. In at least one embodiment, the mounting bracket 208 has one or more holes 230 for removably mounting the mounting bracket 208 between the leg and the seat using screws, bolts, nails, or other fasteners. In another embodiment, the mounting bracket can be mounted directly to either of the leg and/or the seat, rather than or in addition to simply between the leg and the seat. In some embodiments, the mounting bracket 208 may be adhered to the bottom of the seat and/or the at least one leg by any suitable means of adherence, such as but not limited to glue or epoxy. In still other embodiments, the mounting bracket 208 may be integrally formed with the bottom of the seat and/or with the at least one leg. In at least one embodiment, the mounting bracket 208 has a first end 232, a second end 234, a first side 236, and a second side 238. As shown in FIGS. 4-6, the mounting bracket 208 has a top surface 240 and a bottom surface 242. At least a portion of the top surface 240 may be in contact with the bottom of the seat when mounted between the leg and the seat. In some embodiments, the top surface 240 may be configured to mate with surface features of the bottom of the seat. Likewise, at least a portion of the bottom surface 242 may be in contact with the top of the leg when mounted between the leg and the seat. In some embodiments, the bottom surface 242 may be configured to mate with surface features of the top of the leg. In further embodiments, at least a portion of the bottom surface 242 may also be in contact with the storage caddy 210 when the storage caddy 210 is in at least a partially stowed position or the fully stowed position.

In some embodiments as shown in FIGS. 4-6, the mounting bracket may comprise at least one mounting portion 244 for mounting the mounting bracket between the leg and the seat where the leg and the seat connect together, at least one retaining portion 246 for receiving and holding the storage caddy 210, and at least one intermediate portion 248 between the retaining portion 246 and the mounting portion 244. In some embodiments, a retaining portion 246 is formed on each of the first and second sides 236, 238 of the mounting bracket, and there may be an intermediate portion 248 between each of the retaining portions 246 and the mounting portion 244, as shown for example in FIGS. 4-6. The mounting portion 244 may be substantially flat or may have surface features including indentations, holes, and slots that conform to surface features of the bottom of the seat and/or the leg. The intermediate portion 248 joins the mating portion 244 to the retaining portion 246, which is positioned downward relative to the mating portion 244. The intermediate portion 248 may be perpendicular to the mounting portion 244 or at any other suitable angle relative to the mounting portion 244 with respect to the bottom of the seat as illustrated for example in FIGS. 4-6. The relatively lower position of the retaining portion 246 with respect to the mounting portion 244 allows for clearance of the storage caddy 210 relative to the bottom of the seat when the storage caddy is retained on the retaining portion 246 so as to minimize rubbing of the caddy with the bottom of the seat, The retaining portion 246 may include one or more attachment features 250 of the mounting bracket 208 configured to connect with corresponding or mating attachment features 252 on the storage caddy 210, as shown in FIG. 4.

More specifically, the storage caddy 210 may comprise attachment features 252 on at least one of the first side 220, the second side 222, the first end 216, and the second end 218 of the storage caddy 210. In some embodiments, as shown in FIG. 4, the storage caddy 210 comprises attachment features 252 on the first side 220 and the second side 222 for securely holding the storage caddy to the mounting bracket 208. In some embodiments, the storage caddy 210 may additionally or alternatively comprise attachment features 252 on the first end 216 and/or the second end 218 for securely holding the storage caddy to the mounting bracket 208. The attachment features 252 may run along substantially the length of each of the first side 220 and the second side 222. Although, the attachment features 252 need not run the entire length of either side 220, 222, and other suitable configurations are contemplated by this disclosure. The attachment features 252 may be sewn into a wall of the storage caddy or otherwise substantially permanently attached to a wall of the storage caddy, integrally formed with a wall of the storage caddy, or removably connected with a wall of the storage caddy using any suitable means of removable attachment. Similarly, the mounting bracket 208 may comprise attachment features 250 along at least a portion of at least one of the first end 232, the second end 234, the first side 236, and the second side 238. In at least one embodiment, a retaining portion 246 of the mounting bracket comprises at least one attachment feature 250. In at least one embodiment as shown in FIGS. 4-6, the attachment features 250 extend along at least a portion of the retaining portion 246 on the first and second sides 236, 238 of the mounting bracket 208. The attachment features 252 on the storage caddy 210 may be what are referred to herein as "J-clips" as they are shaped somewhat like the letter "J" (shown in FIGS. 7-8) or other clips or hangers that mate with attachment features 250 of the mounting bracket 208, which may be, for example, a rail, lip, tab, rod or other similar feature. The storage caddy 210 thus can hang from the mounting bracket 208, which is fixedly attached between the leg and the bottom of the seat. The storage caddy 210 may also be completely removable from the mounting bracket 208 or may slide along the mounting bracket via the connection between the attachment features 250, 252. In this arrangement, the storage caddy 210 is capable of sliding from a removed position to at least a partially stowed position (shown in FIG. 4) in a direction generally perpendicular to the at least one leg or generally parallel to the bottom of the seat. The storage caddy 210 may further slide from the partially stowed position to a fully stowed position in the direction generally perpendicular to the at least one leg of generally parallel to the bottom of the seat. In other embodiments, the attachment features 250, 252 may comprise snaps, buttons, a hook and fastener system, or other similar attachment features to connect the storage caddy 210 to the mounting bracket 208. In any such embodiments, the storage caddy 210 may be removable from the mounting bracket 208 and easily accessible by at least the user seated on the seat or other user in positioned in the marine craft or other vehicle.

Figure 7:
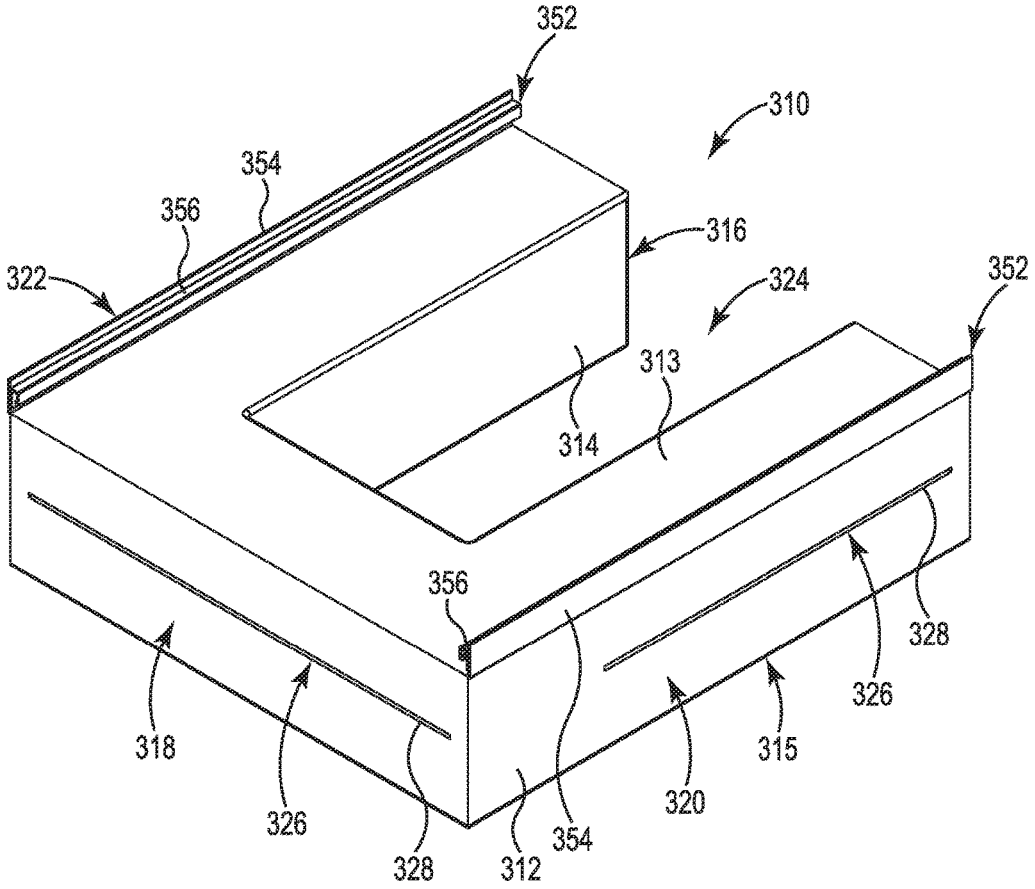
FIG. 7 shows a perspective schematic view of one embodiment of the storage caddy of the storage caddy system in accordance with the present disclosure.
Figure 8:
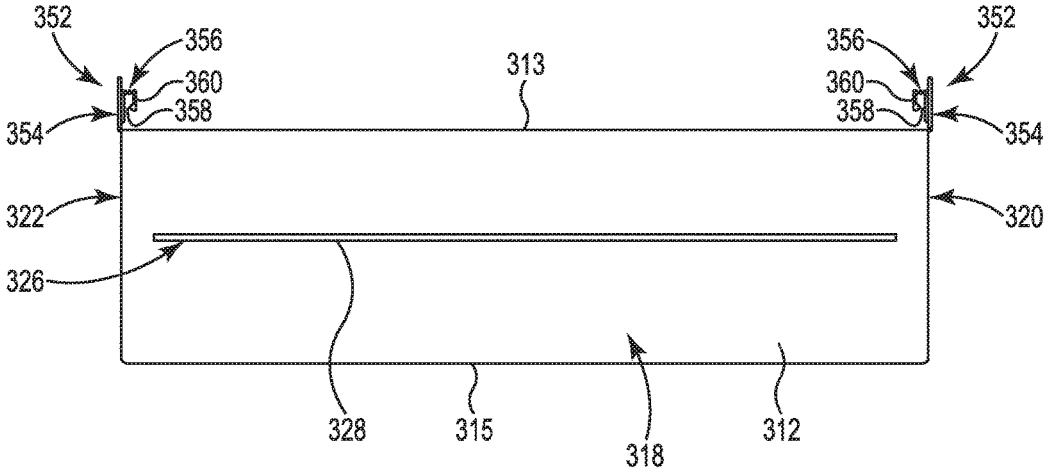
FIG. 8 shows an end schematic view of the storage caddy of FIG. 7.

FIGS. 7-8 show another embodiment of the storage caddy 310 of the present disclosure. To the extent that features of the storage caddy and mounting bracket have been discussed previously above, features of the embodiments in FIGS. 7-8 that are similar to those described above may have the same or similar structure and be made of the same or similar material as those similar features previously described. As shown in FIGS. 7-8, the storage caddy 310 has an outer wall 312, an inner wall 314, a first end 316, a second end 318, a first side 320, and a second side 322. The storage caddy 310 further comprises a top wall 313 and a bottom wall 315. At least one slot 324 may extend from the first end 316 towards the second end 318 between the first side 320 and the second side 322. The at least one slot 324 may be configured to receive the at least one leg attached to the seat and allow movement of the seat relative to the leg. In the embodiment shown, the outer wall 312, the top wall 313, the inner wall 314, and the bottom wall 315 define at least one compartment for storing at least one item. The at least one compartment may be accessible by at least one access point 326 having a closure mechanism 328. The storage caddy 210 may have at least two access points 326, each with a closure mechanism 328, with an access point provided on two or more of sides 318, 320, 322. The storage caddy may have one storage compartment accessible from each of the access points 326 through the closure mechanism 328. In some embodiments, the storage caddy may have at least two to three compartments, each compartment accessible from one of the access points 326 through its respective closure mechanism 328. In some embodiments, the storage caddy may have more than three compartments. As shown in FIGS. 7-8, the storage caddy may further comprise attachment features 352 on each of the first side 320 and the second side 322. As shown the attachment features 352 extend along the entire length of each of the first side 320 and the second side 322, but it is contemplated that the attachment features 352 may only extend along a portion of the length of the sides 320, 322. As shown in FIGS. 7-8, the attachment features 352 each comprise tabs 354 which extend upward from the outer wall 312 and a "J-clip" 356 attached to an inner surface of the tab 354. The tab 354 may comprise the same material as the outer wall 312, or may comprise a different material. The tab 354 may be sewn into the outer wall 312, integrally formed with the outer wall 312, adhered to the outer wall 312, or otherwise attached to the outer wall 312. In at least one embodiment, the tab 354 extends along the entire length of the side 320, 322, but in other embodiments, the tab 354 may extend only along a portion of the side 320, 322. In alternative embodiments, instead of being attached to the outer wall 312, the tab may be attached anywhere along the top wall 313 with similar means and extend upwardly from the top wall 313. The "J-clip" 356 may be sewn to the tab 354, adhered to the tab 354, integrally formed with the tab 354, or otherwise attached to the tab 354. The "J-clip" 356 may comprise a metal or polymer material or combinations thereof. In at least one embodiment, the "J-clip" 356 extends along the length of the tab 354, but in other embodiments, the "J-clip" 356 extends only along a portion of the tab 354. In the embodiment shown, the "J-clip" 356 is positioned on the tab 354 in a downward position, defining a channel 358 between the "J-clip" 356 and the top wall 313. The channel 358 is capable of receiving a mating attachment feature on the mounting bracket, as described previously. The "J-clip" 356 allows the storage caddy 310 to hang onto the mounting bracket, as well as to slide along the mounting bracket for easy removal from the mounting bracket. The "J-clip" 356 may further comprise a knobbed portion 360 at an end, where the knobbed portion 360 narrows the channel 358 to more securely grip the attachment feature of the mounting bracket and help retain the storage caddy 310 on the mounting bracket.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an ingredient or element may still actually contain such item as long as there is generally no measurable effect thereof.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

I claim:

1. A storage caddy system for mounting underneath a seat having at least one leg, the system comprising:

a mounting bracket for attachment between a bottom of the seat and the at least one leg, the mounting bracket having at least two sides, the mounting bracket further comprising:

a mounting portion for mounting the mounting bracket between the bottom of the seat and the at least one leg; and at least one retaining portion on each side of the mounting bracket, each retaining portion having a first attachment feature on a first side of the mounting bracket, wherein the at least one retaining portion has a position relatively lower than the mounting portion; and a storage caddy removably attached to the mounting bracket, the storage caddy comprising at least a bottom wall, an inner wall, and an outer wall, wherein the bottom wall, the inner wall, and the outer wall define at least one storage compartment for storing an item, wherein the at least one storage compartment is accessible by at least one access point in the outer wall, wherein the inner wall defines at least one slot for receiving the at least one leg;

at least one second attachment feature connected to at least one wall of the storage caddy at an upper portion of the storage caddy, each second attachment feature capable of connecting to a mating first attachment feature of the mounting bracket to cause the storage caddy to hang from the mounting bracket.

2. The storage caddy system of claim 1, wherein the storage caddy may be moved relative to the mounting bracket from a partially stowed position to a fully stowed position in a direction perpendicular to the at least one leg.

3. The storage caddy system of claim 1, wherein the outer wall comprises a flexible material.

4. The storage caddy system of claim 1, wherein the second attachment feature of the storage caddy comprises at least one clip.

5. The storage caddy system of claim 4, wherein the at least one clip is a J-clip that defines a channel.

6. The storage caddy system of claim 5, wherein the first attachment feature of the mounting bracket is configured for insertion into the channel of the J-clip.

7. The storage caddy system of claim 1, further comprising dividers positioned in compartments to separate compartments into sections.

8. The storage caddy system of claim 7, wherein each section has at least one access point.

9. The storage caddy system of claim 1, wherein each access point has at least one closure mechanism.

10. The storage caddy system of claim 1, further comprising a safety kit stored within at least one compartment.

11. The storage caddy system of claim 10, wherein the safety kit comprises a fire extinguisher stored in a first compartment of the storage caddy.

12. The storage caddy system of claim 11, wherein the safety kit further comprises a sound making device stored in a second compartment of the storage caddy.

13. The storage caddy system of claim 12, wherein the second compartment is smaller than the first compartment.

14. The storage caddy system of claim 12, wherein the safety kit further comprises a signaling device stored in a third compartment of the storage caddy.

15. A storage caddy system for mounting underneath a seat having at least one leg, the system comprising:

a mounting bracket for attachment between a bottom of the seat and the at least one leg, the mounting bracket having at least two sides; and a storage caddy removably attached to the mounting bracket, the storage caddy comprising:

a bottom wall;

an inner wall having a slot for receiving at least one leg, the inner wall having a U-shaped configuration;

an outer wall;

at least one storage compartment for storing an item, the at least one storage compartment defined by at least the bottom wall, the inner wall, and the outer wall; and at least one access point in the outer wall providing access to the at least one storage compartment when the storage caddy is in any of a fully removed position, a partially stowed position or a fully stowed position;

at least one first attachment feature connected to at least one wall of the storage caddy at an upper portion of the storage caddy, each first attachment feature capable of connecting to a mating second attachment feature of the mounting bracket to cause the storage caddy to hang from the mounting bracket.

16. The removable storage caddy system of claim 15, wherein the mounting bracket further comprises:

a mounting portion for mounting the mounting bracket between the bottom of the seat and the at least one leg; and at least one retaining portion on each side of the mounting bracket, each retaining portion having the second attachment feature on a first side of the mounting bracket, wherein the at least one retaining portion has a position relatively lower than the mounting portion.

17. A removable storage caddy for storage under a seat of the vehicle, the removable storage caddy comprising:

an inner wall defining a slot for receiving at least one leg of a seat of the vehicle, wherein the inner wall has a U-shaped configuration;

an outer wall;

a bottom wall;

at least one storage compartment for storing an item, the at least one storage compartment defined by at least the inner wall, the outer wall, and the bottom wall, wherein the at least one storage compartment is accessible by at least one access point in the outer wall, the at least one access point having a closure mechanism for accessing the item within the storage compartment;

at least one attachment feature at an upper portion of the storage caddy, the at least one attachment feature being capable of being removably engaged with a mating attachment feature mounted underneath the seat to cause the removable storage caddy to hang from the mating attachment feature, the attachment feature comprising:

a tab joined to at least a portion of the outer wall and extending upward from the outer wall;

and a clip joined to the tab, the clip defining a channel for receiving the mating attachment feature.

* * * * *